United States Patent [19]

Bell

[11] 4,099,582

[45] Jul. 11, 1978

[54] DRILLING FLUID COMPENSATION DEVICE

[75] Inventor: Leo A. Bell, Houston, Tex.

[73] Assignee: Martin-Decker Company, a division of Gardner-Denver, Santa Ana, Calif.

[21] Appl. No.: 790,564

[22] Filed: Apr. 25, 1977

Related U.S. Application Data

[63] Continuation-in-part of Ser. No. 720,199, Sep. 3, 1976, abandoned.

[51] Int. Cl.[2] ..... E21B 7/12

[52] U.S. Cl. ..... 175/5; 175/7; 166/0.5

[58] Field of Search ..... 175/5, 7, 25, 38, 48; 166/0.5; 173/153, 155; 254/172; 285/DIG. 1, 299, 302

[56] References Cited

U.S. PATENT DOCUMENTS

| | | | |
|---|---|---|---|
| 2,402,157 | 6/1946 | Griswold | 285/302 X |
| 2,606,003 | 8/1952 | McNeill | 175/7 |
| 3,196,958 | 7/1965 | Travers et al. | 175/7 |
| 3,313,345 | 4/1967 | Fischer | 175/7 X |
| 3,313,358 | 4/1967 | Postlewaite et al. | 175/7 |
| 3,354,950 | 11/1967 | Hyde | 285/302 X |
| 3,612,176 | 10/1971 | Bauer et al. | 166/0.5 |
| 3,910,110 | 10/1975 | Jefferies et al. | 175/48 |
| 3,976,148 | 8/1976 | Maus et al. | 175/48 X |

*Primary Examiner*—Stephen J. Novosad
*Assistant Examiner*—Richard E. Favreau
*Attorney, Agent, or Firm*—Pravel, Wilson & Gambrell

[57] ABSTRACT

In an offshore oil well system wherein a floating well platform is connected through a telescoping cylindrical member to a marine riser extending down to the drilling area, the telescoping cylindrical member being mounted for slidable, sealable movement within the top of the marine riser, said movement occurring as a result of heave of the floating platform due to wave and tide action, a drilling fluid compensator for compensating for a change in the flow of drilling fluid out of the telescoping cylindrical member into the return system.

21 Claims, 5 Drawing Figures

DRILLING FLUID COMPENSATION DEVICE

CROSS-REFERENCE TO RELATED APPLICATIONS

This application is a continuation-in-part of U.S. Pat. application Ser. No. 720,199, filed Sept. 3, 1976, now abandoned.

BACKGROUND OF THE INVENTION

The field of this invention is fluid compensation devices and in particular fluid compensation devices compensating for drilling fluid flow changes in an offshore floating drilling platform fluid return system caused by wave and tide action.

A typical offshore oil well drilling system may include a floating drilling platform which floats on the surface of the water. The floating platform is attached by a telescopic connection to a marine riser which extends downwardly to the ocean floor. The drill string, which is supported on the floating drilling platform and rotated therefrom, is housed within the marine riser. Drilling fluid is circulated downwardly through the drill string from the platform, out the drill bit end and then upwardly in the annular space between the drill string and the marine riser. The telescopic connection between the floating oil well drilling platform and the marine riser is formed by a telescoping cylindrical member which is attached to the floating platform and is mounted for slidable, sealable movement within the top of the marine riser. The telescoping cylindrical member is connected to a drilling fluid return line at an opening in the cylindrical member in order to transfer the upward flowing drilling fluid back into the well fluid system.

Since the oil well drilling platform floats on the surface, the platform is subject to vertical movement or heave as a result of wave and tide action. Vertical movement of the platform causes similar vertical movement of the telescoping member within the marine riser. Movement of the telescoping member downwardly causes an increase in flow space consumed by the drilling fluid above the return opening in the telescoping member, which precipitates a temporary increase in fluid flow in the return line. Further, movement of the telescoping cylindrical member downwardly decreases the available flow space within the marine riser, which also causes an increase in drilling fluid flow. Conversely, upward heave of the platform causes upward movement of the telescoping cylindrical member within the marine riser. This causes a temporary loss or reduction in drilling fluid flow space consumed in the telescoping member. Further, upward movement of the telescoping connection member results in an increase in available flow space within the marine riser and a further decrease or loss in the drilling fluid flow space consumed in the telescoping member. Such increases or decreases in the volume of fluid flowing upwardly from the drill string as a result of heave of the platform complicate the problem of monitoring the return fluid flow rate for the detection of problems downhole. One possible solution to this problem is found in U.S. Pat. No. 3,910,110 of Jefferies et al. The Jefferies patent discloses a system for detecting the commencement of a blowout or lost circulation in a sub-aqueous well being drilled from a floating vessel in which drilling fluid is being used. The rates of flow of the drilling fluid into and out of the well are monitored, compared and a signal proportional to the difference therebetween is produced. The electric signal is modified to compensate for change in the volume of the flow of the drilling fluid caused by the heaving motion of the vessel. Similarly, U.S. Pat. No. 3,976,148 provides a measurement system for measuring variables caused by movement of the telescoping joint mounted in the marine riser and for correlating electrical signals measuring such variables in order to produce a signal proportional to the flow rate of the return drilling fluid flowing in the marine riser annulus. Other patents which may be of interest include U.S. Pat. Nos. 3,760,891; 3,911,740; 3,917,006; 3,905,580; and 3,889,747.

SUMMARY OF THE INVENTION

It is an object of this invention to provide a new and improved drilling fluid compensator device for compensating for volumetric changes in drilling fluid return flow outwardly of a telescoping connector of a marine riser assembly which is part of an offshore oil well platform system.

This object is exemplary only of the objects of this invention. The drilling fluid compensator apparatus of this invention is provided for compensating for changes in volume which occur within a marine riser and within a slip joint assembly mounted with the marine riser due to heave of the floating drilling platform. Due to the heave of the platform and the concomitant movement of the telescoping cylindrical member of the slip joint assembly connected with the marine riser, the flow rate of the drilling fluid flowing out of the cylindrical member to a return line is undesirably changed. The drilling fluid compensator of this invention compensates for volumetric increase and decrease in drilling fluid flow by adjusting for a gain or loss in such flow. The details of this invention will be described in the detailed description to follow. It is to be understood that only the claims of this invention set forth the actual scope of the invention sought herein, and that this summary is intended as no more than a brief recitation of some of the features of this invention.

DESCRIPTION OF THE PREFERRED EMBODIMENT

Figure 2:
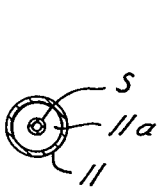
FIG. 2 is a view in cross section taken along line 2—2 of FIG. 1.
Figure 3:
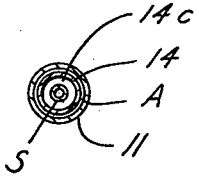
FIG. 3 is a view in cross section taken along line 3—3 of FIG. 1.
Figure 4:
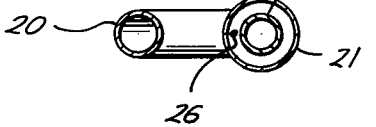
FIG. 4 is a view in cross section taken along line 4—4 of FIG. 1.
Figure 1:
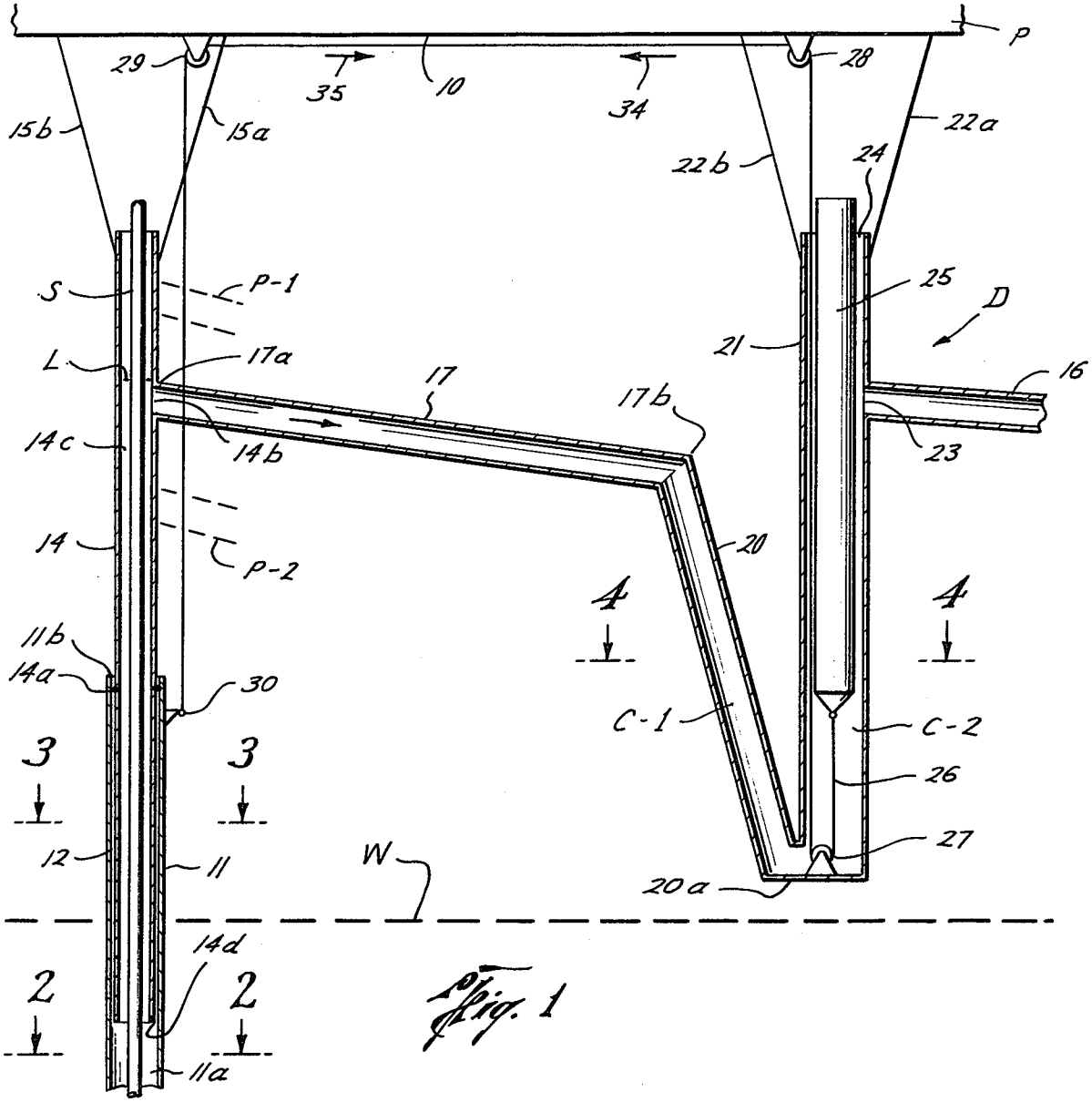
FIG. 1 illustrates a side view partly in schematic of the drilling fluid compensator of the preferred embodiment of this invention.

Referring to FIGS. 1–4 of the drawings, the letter D designates the drilling fluid compensator of the first embodiment of this invention. The drilling fluid compensator D is adapted for attachment to an oil well drilling platform P which, through suitable pontoons or other means (not shown), floats upon the surface of the water W. The floating platform P supports a drill string S on the deck 10 thereof in a known manner. The drill string S extends downwardly from the deck 10 of the platform P through a hollow cylindrical housing called a marine riser 11, through a blowout preventer stack at the ocean floor and suitable casing liners to the actual bore hole being drilled (not shown). Suitable drilling fluid (sometimes called "mud") pumping equipment (not shown) is mounted on the deck 10 of the platform P for pumping drilling fluid downwardly through the drill string S to the drill bit located in the bore hole being drilled. The drilling fluid is circulated out through the drill bit and is returned up the marine riser 11 in the annular area 11*a* (FIG. 2) between the marine riser 11 and the drill string S. Connection of the marine riser 11 to the blowout preventer stack stabilizes the riser so that the riser remains substantially stationary in spite of wave action.

A telescoping connection of slip joint assembly 12 provides a slidable, sealed connection between the stationary marine riser 11 and the heaving platform P in order to receive and transfer the drilling fluid circulated upwardly in the annular area 11*a* between the drill string S and the marine riser 11. The slip joint assembly 12 is provided by a hollow, cylindrical telescoping member 14 which is mounted within top opening 11*b* of the marine riser 11 for slidable, sealable movement within the annular area 11*a*. A suitable seal 14*a* is positioned at or near opening 11*b*. The telescoping member 14 is connected by connection braces 15*a* and 15*b* to the bottom of the deck 10 of the platform P so that the telescoping member 14 moves upwardly and downwardly with the platform P. In this manner, movement of the platform P upwardly and downwardly in response to wave action, commonly called "heave," is transmitted from the platform P to the telescoping member 14 rather than directly to the marine riser 11, thereby preventing damage to the marine riser. In the prior art without the drilling fluid compensator D, the drilling fluid returning upwardly through the annular area 11*a* of the marine riser 11 is circulated out of the telescoping member 14 through an opening 14*b* into a flowline 16 to a fluid separating apparatus, commonly called a "shale shaker," in which the drill cuttings are removed so that the drilling fluid can be pumped downwardly through the drill string S again. Examples of slip joint assemblies include the Vetco Telescopic Joint Assembly illustrated on Pages 4523–4524 of the 1973 Edition of the Composite Catalogue of Oil Field Equipment and Services and the Regan Forge & Engineering Company Telescopic Joint Support System Type KFD-S illustrated on Page 3696 of the 1973 Edition of the Composite Catalogue of Oil Field Equipment and Services. Of course, both of these telescoping systems disclose equipment additional to the basic telescoping cylindrical member 14, but each does include a telescoping member 14 adapted for attachment to the bottom of a floating oil well drilling platform P for movement within a marine riser or similar section in response to wave action.

The drilling fluid compensator D of the first embodiment of this invention includes an intermediate flowline 17 which is attached to the telescoping member 14 at opening 14*b* in order to receive the returning drilling fluid. The intermediate flowline 17 is sloped downwardly from point 17*a* of connection to telescoping member 14 to point 17*b* wherein the intermediate flowline 17 is connected to a first cylindrical housing portion 20. The cylindrical housing portion 20 is basically circular in cross section as viewed along line 4—4 of FIG. 1 and extends downwardly from point of connection 17*b* to the intermediate flowline 17 to a connection section 20*a*. The connection section 20*a* connects the first housing portion 20 to a second housing portion 21. The second housing portion 21 is also cylindrical in cross section. For the purposes of description, the housing portions or pipe sections 20 and 21 form housing chambers C-1 and C-2, respectively.

The conventional flowline 16 for a drilling fluid return system is connected at opening 23 to the housing 21, which extends upwardly from flowline 16 to an opening 24 to the atmosphere.

The drilling fluid circulated upwardly through the marine riser annulus 11*a* flows out of the marine riser 11 up through annular area 14*c* between the drill string S and the telescoping member 14, into the intermediate flowline 17, through first chamber C-1, into second chamber C-2 and upwardly through second chamber C-2 into the flowline 16 connected to the remainder of the drilling fluid treatment system mounted on the platform P in a known manner.

The drilling fluid compensator D includes a volume displacement member 25 mounted within housing 21 of second chamber C-2 in order to compensate for change in available flow space within the marine riser 11 and for a change in flow space consumed in the telescoping member by said drilling fluid due to movement of the telescoping member 14 in response to platform heave. The displacement member 25 is a hollow, cylindrical tube which is attached to cable 26 by suitable means. The cable 26 is mounted about a pulley 27 supported on the bottom of section 20*a*. The cable 26 extends vertically from the pulley 27 to a first platform pulley 28 and runs therefrom to a second platform pulley 29 and finally, the cable is attached to the marine riser 11 by any suitable means at 30. The cable-pulley arrangement 26–30 is designed to move the displacement member 25 in response to movement of the platform P in order to affect the available flow space within the chamber C-2.

Movement of the telescoping member 14 in response to heave of the platform P causes undesirable changes in the flow rate of drilling fluid returning from the marine riser annulus 11*a*. Under what is determined to be a normal or average wave height and tide situation, the level L is located at approximately the opening 14*b* in member 14 and the drilling fluid normally flows outwardly of opening 14*c* at a rate dependent on pressure below, which determines the level L of fluid in the telescoping member 14. Whenever the platform P and member 14 are moved upwardly, the position of opening 14*b* is moved upwardly to new position P-1. In this case, flow through the telescoping member opening 14*b* is temporarily interrupted and will not resume again until the flow level reaches approximately point L again, above the new position P-1 of flowline 17. The loss in flow space consumed by the drilling fluid due to upward heave of the platform P will be equal to the length or amount of upward movement of the telescoping connection 14 times the annular area 14*c*. The annular area 14*c* is equal to the cross-sectional area defined by the internal diameter of the telescoping section 14*a* minus the cross-sectional area of the drill string S.

Movement of the telescoping member 14 in response to upward platform heave also causes a change in available flow space within the marine riser 11 itself. The available flow space within the marine riser 11 from the blowout preventer stack at the bottom wellhead (not shown) up to line 2—2 is equal to the length of the marine riser times the cross-sectional area defined by the internal diameter of the marine riser 11 minus the cross-sectional area of the drill string S. However, above that point, the available flow space within the marine riser 11 will vary with the position of the telescoping member 14. The area affected by the telescoping member 14 is equal to the annular area of the end or rim portion 14*d* of the member 14. The volume of fluid affected by movement of the telescoping member 14 is equal to the annular area of the rim 14*d* times the amount or length of movement of the telescoping member 14. Therefore, upward movement of the telescoping member 14 will cause a gain in available flow space within the marine riser 11 which is equal to the annular area of the rim 14*d* times the length of upward movement of the telescoping member 14. A gain in flow space in riser 11 is equilavent to an equal volumetric loss in flow space consumed by the drilling fluid in telescoping member 14. The consequent loss of flow space consumed by the increase in available flow space in riser 11, due to upward movement of member 14, is added to the loss in flow space consumed by drilling fluid in the member 14 itself. Combined together, the volumetric loss in flow space consumed by the drilling fluid in member 14 must be refilled before flow will again occur into line 17. This volumetric loss is equal to the annular area 11*a* of the marine riser, which would be the sum of the annular area 14*c* plus the area of the annular rim 14*d* times the distance moved by the telescoping section. This is equivalent to multiplying the cross-sectional area defined by the outside diameter of the telescoping joint 14, minus the cross-sectional area of the drill string S, times the length or amount of upward movement of the member 14.

Conversely, downward movement of the telescoping member 14 and flowline 17 to position P-2 causes a decrease in available flow space within the marine riser 11 and an overflow or buildup of drilling fluid in member 14 above the opening 14*b*. Thus, downward movement of the platform P causes downward movement of the telescoping member 14 while the liquid level line L remains substantially unchanged. The amount of overflow or buildup with respect to opening 14*b* will be equal to the annular area 14*c* previously defined times the length of movement of telescoping member 14 downwardly. Further, downward movement of the telescoping member 14 causes an actual reduction in available flow space within the marine riser 11. This volumetric reduction is equal to the area of the annular rim 14*d* of the telescoping member 14 times the distance of movement of the member 14 downwardly. The reduction in available flow space in riser 11 causes an additional increase in flow space consumed in member 14. The combined excess volume of fluid which must be dissipated before the drilling fluid approaches the original level L with respect to opening 17 is equal to the area affected times the length of downward movement of the telescoping member 14. The area affected is the same as the area affected by upward movement of the telescoping member 14: The combined area of the annular rim 14*d* plus the annular area 14*c*. The movement downwardly of the telescoping member 14 and flowline 17 with respect to the liquid level L causes an increase in hydrostatic pressure (due to the level L being higher from opening 14*b* than before) and thus of flow rate of the drilling fluid flowing into the line 17, which increase in flow rate will continue until the fluid level is lowered to approximately the level L with respect to opening 14*b* at the initial position.

The drilling fluid compensator D of this invention is designed to neutralize the effect of changes in flow of drilling fluid flow outwardly of the telescoping member 14. In the embodiment of the invention illustrated, the cable-pulley arrangement 26–30 is designed to move the displacement member 25 within chamber C-2 in the direction opposite from movement of the telescoping member 14, but for the same distance. Further, the housings 20 and 21 for chambers C-1 and C-2, which are connected through intermediate flowline 17 directly to the telescoping member 14, move with the telescoping member 14 upwardly or downwardly a distance equal to the exact distance moved by such member. The combined movement of the housing 20 and of the displacement member 25 is designed to change the available flow space within the chamber C-2 to compensate for a gain or loss in flow within the marine riser 11 and telescoping member due to a movement of the telescoping member 14 in response to platform heave.

The volume or available space displaced within the chamber C-2 is equal to the cross-sectional area of the hollow cylindrical displacement member 25 measured along line 4—4 multiplied by the combined relative movement of the displacement member 25 and chamber housing 21. The compensator D neutralizes the change in flow space consumed in telescoping member 14 by providing an equal but opposite change in available flow space in chamber C-2. The area of displacement member 25 is equal to the annular area affected by movement of the member 14, which is equal to the cross-sectional area defined by the outside diameter of the telescoping member 14 minus the cross-sectional area of the drill string S (or, annular rim area 14*d* plus annular area 14*c*, hereinafter referred to as A).

OPERATION AND USE

Let us first take the situation where wave action causes the platform P and telescoping member 14 to move upwardly through a specific distance of one foot. Movement of the telescoping member 14 upwardly one foot will cause the opening 14*b* to move above the level L of fluid in annular area 14*c* which causes a temporary reduction or loss of drilling fluid flow. This loss may be defined in terms of the reduction in space formerly consumed by such drilling fluid in the member 14 with respect to opening 14*b*.

Movement of the telescoping member 14 upwardly causes the housing 21 to also move upward an equal distance of one foot due to the connection to flowline 17, which are both supported on platform 10. The displacement member 25 actually remains in the same relative position with respect to riser 11, but the housing 21 is moved up one foot, which moves the displacement member one foot further into the chamber C-2. Movement of the displacement member 25 further into chamber C-2 causes a decrease in available flow space within the chamber C-2. The amount of decrease in available flow space or volume in chamber C-2 is equal to the amount of relative vertical movement, here one foot, multiplied times the cross-sectional area of member 25; and the cross-sectional area of displacement member 25 is equal to the area A.

Thus, in response to a decrease in flow space consumed in member 14 due to upward movement of the telescoping member 14 a distance of one foot, the compensator D of this invention will cause a decrease in available flow space or volume within the chamber C-2 equal to the volumetric decrease in flow space consumed within the member 14. The decrease in flow space in chamber C-2 will cause a temporary increase in flow into line 16, which at least in part compensates for the temporary loss in flow out of member 14.

If the telescoping member 14 is moved downwardly a distance such as one foot, the housing 21 is moved downwardly a like distance of vertical movement or one foot. With the displacement member 25 maintaining the same position relative to riser 11, the displacement member 25 is positioned outwardly of the compensator chamber C-2 an amount equal to the one foot amount of vertical downward movement of the telescoping member 14. Since the cross-sectional area of the displacement member 25 is that of the area A, the volumetric addition of available flow space within the chamber C-2 neutralizes the volumetric addition of drilling fluid flow space consumed in member 14. The increase in flow space in C-2 will cause a decrease in flow out of the chamber C-2 to at least partially offset the increase in flow out of member 14.

In this example, the pulley arrangement 26–30 and the housing portions 20 and 21 connected through intermediate flowline 17 cooperate to move the displacement member 25 within chamber C-2 an amount equal to the movement of the telescoping member 14 in response to platform P. If it is necessary to use a different ratio of vertical moving distances of the telescoping member 14 and displacement member 25 and housing 21, the cross-sectional area of the displacement member 25 will change so that the volume compensator D exactly compensates for the change in volume of flow space consumed in telescoping member 14.

Figure 5:
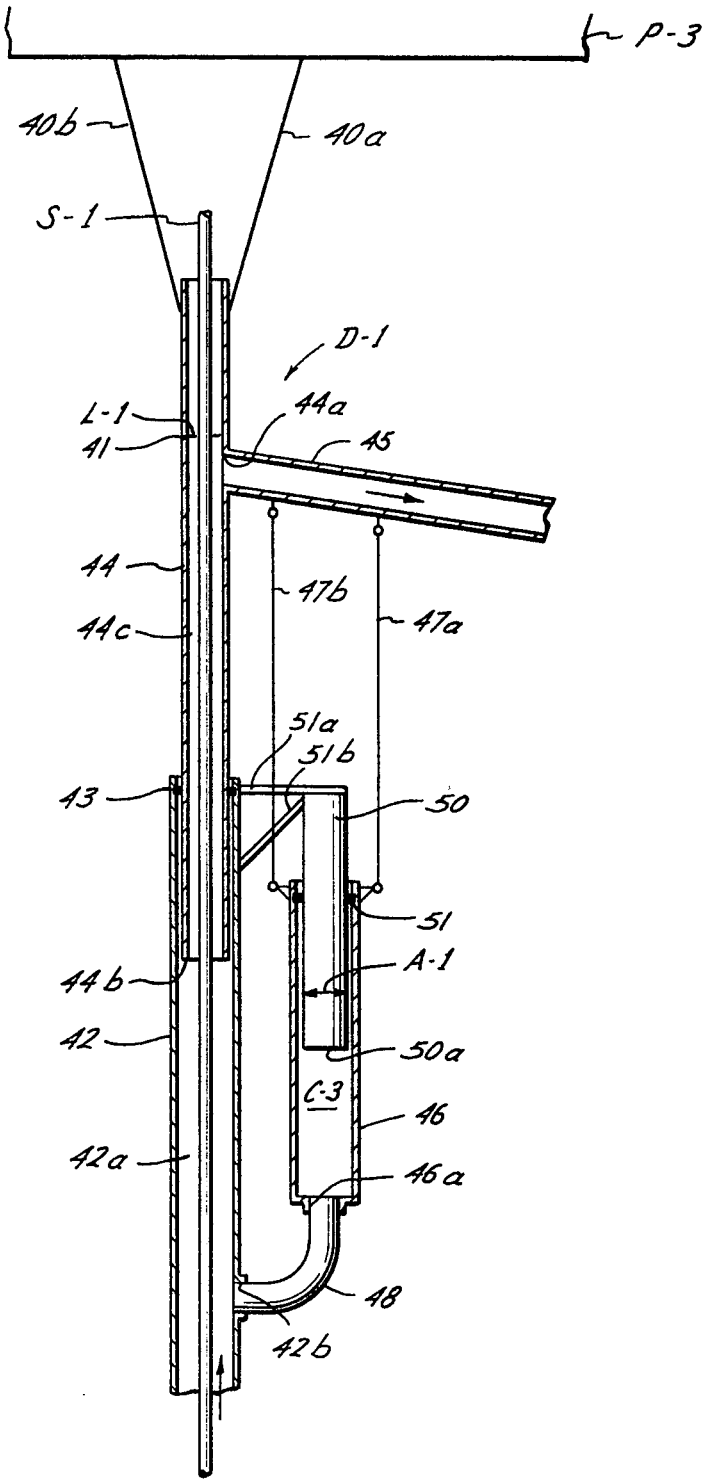
FIG. 5 is a side, partly schematic, sectional view of another embodiment of this invention.

Referring to FIG. 5, a second embodiment D-1 for a return drilling flow compensator is illustrated. In FIG. 5, a telescoping connection or slip joint assembly 41 is attached to the floating drilling platform P-3 by braces 40*a* and 40*b*. The telescoping assembly 41 is mounted within the marine riser 42 for slidable, sealable movement therein by means of seal 43. The drill string S-1 extends downwardly from the platform P-3 and through the telescoping assembly 41 and marine riser 42 down to the bottom of the body of water and into the bore hole therebelow. As previously described, the marine riser 42 is mounted to a blowout preventer stack (not shown) positioned on the floor of the body of water so that the marine riser is stationary in spite of heave of the platform P-3. But, the telescoping assembly 41 moves with the heaving platform P-3.

The telescoping assembly 41 includes a substantially cylindrical hollow portion 44 having an opening 44*a* in which return flowline 45 is mounted. The annular area between the drill string S-1 and the inside wall of the marine riser is defined as 42*a*. The telescoping member 44 terminates in a bottom rim portion 44*b* and defines an annular area 44*c* between the inside wall thereof and the drill string S-1. The original position of the telescoping assembly 41 is such that the level L-1 of return drilling fluid is slightly above the opening 44*a* to the return flowline 45.

Whenever the platform P-3 and telescoping member 44 is moved downwardly, the level L-1 of return drilling fluid is positioned a greater distance above the opening 44*a* to the return flowline 45 (which moves down with member 44). The volume of fluid positioned between the new level and the former level, with respect to the lower position of opening 44*a*, is equal to the amount of vertical downward movement of the telescoping assembly 41 (the downward heave of the platform P-3) multiplied times the sum of the area 44*b* of the telescoping member rim and annular area 44*c*. Thus, in response to downward movement of the platform P-3, an additional hydrostatic head of drilling fluid is created above the return flowline 45 which causes an increase in flow which will upset any readings being taken of the volume flow through the flowline 45 for the purpose of monitoring downhole pressure.

Conversely, whenever the platform P-3 and telescoping assembly 41 is moved upwardly, the level L-1 is positioned at a point lower than the former level with respect to opening 44*a*, which is moved upwardly. The amount of volume necessary to add to the system to compensate for movement of the telescoping member 44 upwardly is equal to the vertical distance of movement times the sum of the rim area 44*b* and annular area 44*c*.

The drilling fluid compensator D-1 of the second embodiment of this invention compensates for movement of the telescoping assembly 41 upwardly and downwardly in order to eliminate the effect of such upward and downward movement on the flow of drilling fluid returning through the return flowline 45.

The drilling fluid compensator D-1 includes a substantially hollow cylindrical chamber housing 46 attached to the return flowline 45 by braces 47*a* and 47*b* such that the chamber housing moves upwardly and downwardly with the telescoping member 41. The housing 46 is basically cylindrical in configuration thus forming a cylindrical chamber C-3 therein. The housing 46 terminates in opening 46*a* and a flexible, tubular connection or hose 48 extends from connection in housing opening 46*a* into connection with marine riser opening 42*b* in order to provide fluid communication between return drilling fluid in the annular area 42*a* and the chamber C-3.

A displacement member 50 is attached by bracing members 51*a* and 51*b* to the marine riser 42. Since the marine riser 42 remains stationary, the displacement member 50 also remains stationary. The displacement member 50 is a generally cylindrical piston closed at bottom end 50*a*. A sealing element 51 is mounted between the member 50 and the inside wall of the chamber housing 46*a* to allow slidable, sealable movement between the displacement member 50 and the chamber housing 46. The cross-sectional area A-1 of the displacement member 50 is equal to the sum of the annular rim area 44*b* plus the annular telescoping member area 42*c*— the areas which affect the level L-1 of fluid with respect to the position of the opening 44*a* for the return flowline 45.

In response to upward movement of the flowline 45 due to upward heave of the platform P-3, the chamber housing 46 is moved upwardly a distance equal to the upward heave of the platform P-3. Upward movement of the chamber housing 46 positions the displacement member 50 further in the chamber C-3, which displaces a volume of fluid outwardly of the chamber C-3 into the annular marine riser area 42*a*. The volume of fluid displaced outwardly of the chamber C-3 in response to upward movement of the return flowline 45 is equal to the area A-1 times the vertical distance of movement of the housing 46 upwardly. Since the area A-1 is equal to the sum of the areas affected by vertical movement upwardly of the telescoping member 44, and since the chamber housing 46 moves the same distance upwardly as the telescoping member 44, the volume of fluid injected into the marine riser area 42*a* is equal to the volume of fluid necessary to return the level of drilling fluid to its former position L-1 slightly above the relocated opening 44a. In this manner, the amount of fluid necessary to return the level L-1 to its initial position slightly above the opening 44a is injected into the marine riser annular area 42a thereby preventing a loss of flow which would provide false readings upon instrumentation located within the return flowline 45.

Similarly, whenever the telescoping member 44 and return flowline 45 are moved downwardly, the chamber housing 46 is also moved downwardly a like distance. Movement of the chamber housing 46 downwardly increases the volume within chamber C-3 by an amount equal to vertical movement of the chamber housing 46 downwardly times the area A-1 of the displacement member 50. This volume of additional space provided within the chamber C-3 is equal to the volume of fluid which places the level of drilling fluid at an undesirably high level with respect to the position of the opening 44a. Thus the chamber C-3 serves to receive the amount of drilling fluid which would otherwise provide a new and increased hydrostatic head above the opening 44a in the telescoping member 44 and thus provide an undesirable increase in flow and pressure in the return flowline 45.

In this manner, the volume compensator D-1 serves to remove and inject a volume of drilling fluid into the marine riser area 42a sufficient to neutralize relative increases or decreases in the level of drilling fluid with respect to the marine riser opening 44a. Therefore, the drilling fluid flow rate and pressure through return flowline 45 is not substantially affected by upward and downward movement of the platform P-3 and telescoping member 44 so that readings taken within flowline 45 may more properly reflect actual well conditions.

The foregoing disclosure and description of the invention are illustrative and explanatory thereof, and various changes in the size, shape and materials as well as in the details of the illustrated construction may be made without departing from the spirit of the invention.

I claim:

1. In an offshore oil well drilling system wherein a drilling platform is subjected to wave and tide action causing such platform to heave and wherein the drill string therefor is housed in a marine riser which is connected to the platform through a telescoping connection having a return flowline, the annular area between said marine riser and the drill string serving as a return path for drilling fluid, the flow of such returning drilling fluid through such return flowline being affected by the heave of the drilling platform, a drilling fluid flow compensator, comprising:

a telescoping cylindrical member adapted for mounting in said marine riser and for connection with such platform for slidable, sealed movement in said marine riser in response to heave of such platform from wave action, said telescoping cylindrical member having a return flowline connected therewith for receiving such returning drilling fluid from said marine riser and telescoping cylindrical member; and volume compensation means connected with said return flowline for substantially neutralizing the effect of wave and tide action on the flow of such return drilling fluid through said return flowline.

2. The structure set forth in claim 1, wherein movement of said telescoping cylindrical member in response to wave and tide action causes a change in flow space consumed by said drilling fluid in said marine riser and telescoping member, which causes a change in flow of such returning drilling fluid through said return flowline due to such wave and tide action, said volume compensation means including:

means for compensating for a change in returning drilling fluid flow as a result of a change in flow space consumed by said drilling fluid in such marine riser and telescoping member in response to movement of said offshore drilling platform.

3. The structure set forth in claim 1, wherein movement of said telescoping cylindrical member in response to wave and tide action causes a change in flow space consumed by said drilling fluid in said marine riser and said telescoping member, which causes a change in the flow of drilling fluid returning through said return flowline, said volume compensation means including:

a volume compensation chamber mounted in said return flowline for receiving drilling fluid flowing upwardly from such marine riser through said telescoping connection and return flowline to said volume compensation chamber, said chamber having available flow space to receive said drilling fluid; and volume adjustment means mounted in said volume compensation chamber for adjusting said available flow space in said volume compensation chamber in response to a change in flow space consumed by said drilling fluid in said marine riser and said telescoping member.

4. The structure set forth in claim 3, wherein said volume adjustment means includes:

means for adding to the available flow space in said volume compensation chamber in response to movement of said platform downwardly.

5. The structure set forth in claim 3, wherein said volume adjustment means includes:

means for reducing the available flow space in said volume compensator in response to movement of said platform upwardly.

6. The structure set forth in claim 3, wherein said volume adjustment means includes:

means for adding to the available flow space in said volume compensation chamber in response to an increase in flow space consumed by said drilling fluid in said marine riser and telescoping connection.

7. The structure set forth in claim 3, wherein said volume adjustment means includes:

means for reducing the available flow space in said volume compensator in response to a loss in flow space consumed by said drilling fluid in said telescoping connection and in said marine riser.

8. The structure set forth in claim 3, wherein said volume adjustment means includes:

a fluid displacement member and mount means mounting said fluid displacement member for movement in said volume displacement chamber.

9. The structure set forth in claim 8, including:

the amount of flow space consumed or reduced in said marine riser and telescoping connection being equal to the vertical distance said telescoping member is moved in response to heave of said platform multiplied by the cross-sectional area of said telescoping member defined by the outside diameter thereof minus the cross-sectional area of said drill string; and the amount of change in available flow space in said chamber is equal to the distance which said displacement member and housing for said chamber are moved multiplied by the area of said displacement member, said distance which said displacement member is moved being dependent upon said mount means, said volume compensation means balancing a change in flow space consumed by said drilling fluid with an equal but opposite change in flow space available in said chamber.

10. The structure set forth in claim 8, wherein said mount means includes:

platform connection means connecting said displacement member to said platform for movement in response to movement of said platform.

11. The structure set forth in claim 10, wherein said mount means includes:

pulley connection means connecting said displacement member to said marine riser through connection to said platform for movement in response to movement of said telescoping member.

12. The structure set forth in claim 11, wherein said platform connection and pulley connection means includes:

a pulley-cable combination wherein pulleys are attached to said platform and a cable operatively extends from said marine riser through said pulleys attached to said platform and to said displacement member.

13. In an offshore oil well drilling system for drilling a bore hole from a drilling platform which is subjected to wave and tide action causing such platform to heave, the drilling system including a drill string which extends from the platform downwardly through the body of water and into the bottom for drilling the bore hole, the drill string being surrounded by a marine riser which is mounted onto the bottom; a telescoping connection attached to the drilling platform and being mounted with the marine riser for slidable, sealable movement therein, said drill string extending downwardly through the telescoping connection and the marine riser; the telescoping connection having a return flowline providing a path for drilling fluid flowing upwardly through the marine riser in the annular area between the marine riser and the drill string and between the telescoping connection and the drill string, a drilling fluid flow compensator, comprising:

volume compensation means mounted in fluid communication with the marine riser and for movement with the telescoping connection, which moves in response to the heave of the drilling platform, for adding and removing drilling fluid from the marine riser and telescoping connection in response to upward and downward heave, respectively, of said floating drilling platform in order to substantially neutralize the effect of heave of the drilling platform on the return flow of drilling fluid through the return flowline.

14. The structure set forth in claim 13, including:

the volume amount of drilling fluid level change with respect to the return fluid flowline as a result of upward movement of said telescoping member being equal to the distance of upward movement of said telescoping member multiplied times the cross-sectional area of the outer diameter of said telescoping member minus the area of said drill string; and said volume compensation means injecting a volume of fluid into said marine riser equal to said volume fluid change as a result of said upward movement of said telescoping member.

15. The structure set forth in claim 13, including:

the volume amount of drilling fluid level change with respect to the return fluid flowline as a result of downward movement of said telescoping member being equal to the distance of downward movement of said telescoping member multiplied times the cross-sectional area of the outer diameter of said telescoping member minus the area of said drill string; and said volume compensation means removing a volume of fluid from said marine riser equal to said volume fluid change as a result of said downward movement of said telescoping member.

16. The structure set forth in claim 13, wherein movement of said telescoping connection in response to movement of said drilling platform causes a change in flow space consumed by said drilling fluid in said marine riser and telescoping connection which causes a change in flow of such returning drilling fluid through said return flowline due to such wave and tide action, said volume compensation means including:

means for compensating for a change in returning drilling fluid flow as a result of change in flow space consumed by said drilling fluid in said marine riser and telescoping member in response to heave of said offshore drilling platform.

17. The structure set forth in claim 13, including:

a chamber housing adapted for positioning adjacent to such marine riser in fluid communication with the riser;

chamber housing mount means mounting said chamber housing to said marine riser for fluid communication therebetween and for movement with respect thereto, said chamber housing mount means attaching said chamber housing to the telescoping connection for movement therewith;

a displacement member mounted in said chamber and being adapted for attachment to said marine riser and seal means mounting said chamber housing and displacement member for slidable, sealable movement with respect to each other; and said chamber housing and displacement member cooperating to add drilling fluid to the marine riser and telescoping connection in response to upward heave of said drilling platform and telescoping connection and further cooperating to remove drilling fluid from said marine riser and telescoping connection into said chamber in response to downward movement of the drilling platform and telescoping connection.

18. The structure set forth in claim 17, including:

the telescoping connection including a generally cylindrical member adapted for mounting in said marine riser and for connection with such platform for slidable, sealed movement in said marine riser in response to heave of such platform, said telescoping cylindrical member having the return flowline connected therewith for receiving such returning drilling fluid from said marine riser and telescoping cylindrical member;

said chamber housing being attached to said return flowline; and said chamber housing mount means including a flexible tubular connection extending from said chamber housing to said marine riser to allow said chamber housing to move vertically with respect to said marine riser with vertical movement of said telescoping cylindrical member and return flowline.

19. The structure set forth in claim 18, including:

said displacement member being fixedly attached to said marine riser; and said chamber formed by cooperation of said chamber housing and displacement member being adjustable in volumetric capacity in response to upward and downward movement of said telescoping cylindrical member and return flowline.

20. The structure set forth in claim 19, including:

said volumetric capacity of said chamber increasing in response to a downward vertical movement of said telescoping connection and a consequent decrease in available flow space in said marine riser due to such downward movement of said telescoping cylindrical member therein whereby drilling fluid from said marine riser flows into said chamber in order to prevent an increase in flow through said return flowline.

21. The structure set forth in claim 19, including:

the volumetric capacity in said chamber formed by said chamber housing and displacement member being decreased in response to an upward movement of said telescoping member and corresponding increase in available flow space within said marine riser as a result of upward movement of said telescoping cylindrical member therein whereby drilling fluid located within said chamber is displaced into said marine riser in order to prevent a decrease in drilling fluid flow through said flowline.

* * * * *